United States Patent [19]

Haddad et al.

[11] Patent Number: 4,875,994

[45] Date of Patent: Oct. 24, 1989

[54] PROCESS AND APPARATUS FOR CATALYTIC CRACKING OF RESIDUAL OILS

[76] Inventors: James H. Haddad, 45 Van Wyck Dr., Princeton Junction, N.J. 08550; Hartley Owen, 5 Riverview Ter., Belle Mead, N.J. 08502; Klaus W. Schatz, 136 Rolling Hill Rd., Skillman, N.J. 08558

[21] Appl. No.: 206,243

[22] Filed: Jun. 10, 1988

[51] Int. Cl.[4] ..... C10G 11/18; B01J 38/34

[52] U.S. Cl. ..... 208/113; 208/52 CT; 208/91; 208/149; 208/155; 208/164; 208/251 R; 502/43; 502/49

[58] Field of Search ..... 208/155, 113, 52 CT, 208/91, 149, 251 R, 164; 502/43, 49

[56] References Cited

U.S. PATENT DOCUMENTS

| | | | |
|---|---|---|---|
| 2,742,403 | 4/1956 | Nicholson et al. | 208/161 |
| 2,775,548 | 12/1956 | Kollgaard | 502/49 |
| 2,856,351 | 10/1958 | Welty, Jr. et al. | 208/149 |
| 3,092,568 | 6/1963 | Atteridg | 208/113 |
| 3,197,284 | 7/1965 | Hoekstra | 502/49 |
| 3,856,659 | 12/1974 | Owen | 208/164 |
| 4,116,814 | 9/1978 | Zahner | 208/78 |
| 4,260,475 | 4/1981 | Scott | 208/164 |
| 4,289,605 | 9/1981 | Bartholic | 208/113 |
| 4,336,160 | 6/1982 | Dean et al. | 208/113 |
| 4,384,949 | 5/1983 | Reagan et al. | 208/251 R |
| 4,407,714 | 10/1983 | Myers et al. | 208/120 |
| 4,605,636 | 8/1986 | Walters et al. | 208/113 |
| 4,666,586 | 5/1987 | Farnsworth | 208/164 |
| 4,717,467 | 1/1988 | Haddad et al. | 208/113 |
| 4,737,345 | 4/1988 | Haddad et al. | 422/109 |
| 4,786,400 | 11/1988 | Farnsworth | 208/164 |
| 4,789,458 | 12/1988 | Haddad et al. | 208/151 |

*Primary Examiner*—Anthony McFarlane
*Attorney, Agent, or Firm*—Alexander J. McKillop; Charles J. Speciale; Richard D. Stone

[57] ABSTRACT

A process and apparatus for cracking heavy hydrocarbons using a mixture of fluid cracking catalyst and a demetallizing additive differing in physical characteristics from the cracking catalyst is described. A heavy, metals containing feed such as a resid contacts demetallizing additive in the base of a riser reactor. The demetallized resid is cracked by contact with a stream of hot, regenerated catalyst. A mixture of metal containing additive, deactivated cracking catalyst, and cracked products is discharged from the riser. The metal containing additive and deactivated catalyst are stripped, preferably with steam, and charged to a two-stage regenerator. The first stage of the regenerator partially regenerates the cracking catalyst and separates it by elutriation from the demetallizing additive, which accumulates as a dense phase fluidized bed in a lower portion of the first stage regenerator. Partially regenerated cracking catalyst is carried up out of the first stage regenerator and regeneration is completed in a second stage regenerator by contact with an oxygen containing gas. Demetallizing additive is withdrawn from the first stage of the regenerator and charged to the base of the riser. Hot regenerated cracking catalyst is withdrawn from the second stage regenerator and recycled to the riser. Preferably, heat removal means are provided in the first or second stage regenerator, the additive return line, or the regenerated catalyst return line to the riser. An additional stripping stage, preferably a hot stripper operating with CO as a stripping gas, may be provided intermediate the conventional stripping section and the regenerator.

12 Claims, 1 Drawing Sheet

PROCESS AND APPARATUS FOR CATALYTIC CRACKING OF RESIDUAL OILS

BACKGROUND OF THE INVENTION

The FCC, or fluidized catalytic cracking process, is a mature process. It is used to convert relatively heavy, usually distillable, feeds to more valuable lighter products. There is an increasing need in modern refineries to convert more of the "bottom of the barrel" to more valuable lighter products, e.g., resids or residual oil fractions.

In the past these heavy streams were subjected to various thermal processes such as coking or visbreaking to convert them to more valuable products. Unfortunately, thermal processing alone has not proved to be a complete answer to the problem, as the products of thermal cracking are themselves relatively low valued products, such as heavy fuel oil from visbreaking or coker naptha or coker gas oil from coking operations. In the case of coking, very large coke yields result in large volumes of low value product.

Residual oils have a large percentage of refractory components such as polycyclic aromatics which are difficult to crack. Resids also contain large amounts of metals which rapidly deactivate conventional catalyst. Some attempts at catalytic processing of these stocks have been made e.g., adding relatively small amounts of residual oil to conventional FCC feed. FCC units can tolerate modest amounts of resids in the feed, e.g., 5–10 wt percent but the heavy feeds increase the burning load on the regenerator (because of their high Conradson carbon content) and poison the catalyst, with nickel and vanadium. Limiting the amount of resid in the FCC feed has been the method of choice in controlling regeneration operation, although consideration has been given to adding catalyst coolers. The nickel and vanadium contamination problem can be overcome to some extent by practicing metals passivation, e.g., addition of antimony to the unit to passivate the metals added with the feed. Metals passivation has allowed FCC units to continue operating with catalyst containing relatively high amounts of nickel and vanadium, but has not been a complete solution. The vanadium seems to attack the zeolite structure of modern FCC catalyst, resulting in rapid loss of catalyst activity. The exact cause of vanadium poisoning is not completely understood, but it is believed that oxidized vanadium compounds are formed in the highly oxidizing atmosphere of conventional FCC regenerators and these compounds, particularly vanadic acid rapidly attack the zeolite. The problem is discussed in Vanadium Poisoning of Cracking Catalyst, Wormsbecher et al, Journal of Catalysis, 100, 130–137 (1986).

Most refiners now monitor the metals concentration on their catalyst and dump equilibrium catalyst and replace it with fresh catalyst to control the average level of metal on the catalyst. Such a solution is expensive because it can result in very high catalyst replacement rates.

Another approach to adding residual oils to FCC units is described in U.S. Pat. No. 3,886,060, which is incorporated herein by reference. Residual oil was used as a quench medium to limit the conversion of a recycle oil in a riser conversion zone. The preferred catalysts were dual components, i.e., containing both large and small pore size zeolites. A single regenerator operated with dual riser reactors.

Despite the many improvements which have been made, attempts to crack resids have not have been too successful, primarily because of the large amounts of metal and coke associated with such feeds. We have now discovered a way to handle such difficult stocks in a single riser reactor, using a two stage regenerator. In this approach, we use a mixture of coarse and conventional catalyst in a single riser reactor with a two stage regenerator to achieve some unusual results.

By careful selection of the catalyst sizes and of the superficial vapor velocities in the catalyst regenerator it is possible to keep the coarse catalyst effectively segregated from the conventional catalyst. The coarse catalyst is regenerated in a single stage, under relatively mild conditions which minimize oxidation of vanadium compounds on the catalyst but which still remove much of the hydrogen content of the coke and eliminate most of the water precursors. The conventional FCC catalyst is regenerated to some extent in the first stage regenerator, and then undergoes a second stage of regenerator, at a higher temperature, with higher oxygen concentrations. Use of two different kinds of catalyst, in a two stage regenerator, permits significantly higher metals levels to be tolerated in the feed.

BRIEF SUMMARY OF THE INVENTION

Accordingly, the present invention provides a process for the catalytic cracking of a heavy, metals laden feed by contacting a hot regenerated catalyst stream with the feed in a base of riser reactor, cracking the feed in the riser reactor to form cracked products and coked catalyst, separating the coked catalyst from cracked products, stripping the coked catalyst with stream and regenerating stream stripped catalyst in a catalyst regenerator with an oxygen-containing gas to form hot regenerated catalyst, characterized by using a mixture of fluidizable catalytic cracking catalyst, and additive, which mixture is resolvable by elutriation; demetallizing the feed by contacting the feed in the base of the riser with the additive and removing a majority of the metals and some coke precursors from the feed to produce a coked additive containing a majority of the metals content of the feed and demetallized feed; cracking the demetallized feed in the riser with the hot regenerated cracking catalyst and discharging from the riser cracked products and a mixture of coked cracking catalyst and coked additive; regenerating the mixture of coked cracking catalyst and coked additive with an oxygen containing gas in a first stage regenerator having a base, inlets for coked catalyst and additive, an upper outlet and a lower outlet to form a dense, fluidized bed of regenerated additive with a reduced coke content and partially regenerated catalytic cracking catalyst; removing from the lower outlet of the first stage regenerator the regenerated additive and recycling it to the base of the riser reactor; removing from the upper outlet of the first stage regenerator, the partially regenerated catalytic cracking catalyst and discharging it into a second stage regenerator; contacting the partially regenerated catalytic cracking catalyst with an oxygen containing gas in the second stage regenerator to produce regenerated catalytic cracking catalyst; recycling regenerated catalytic cracking catalyst from the second stage regenerator to the riser reactor to crack demetallized resid feed.

In an apparatus embodiment, the present invention provides an apparatus for the fluidized catalytic cracking of a heavy metals laden feed by adding the feed to the base of a riser reactor and contacting it therein with a stream of hot regenerated catalytic cracking catalyst, to form coked catalyst and cracked products, discharging coked catalyst and cracked products from the riser outlet, separating cracked products from coked deactivated catalyst, stripping coke deactivated catalyst, and regenerating the coke deactivated catalyst in a two stage regenerator with an oxygen containing gas characterized by a demetallizing riser reactor comprising; a demetallizing section at the base of the riser having an inlet for heavy feed, an inlet for a demetallizing additive and an outlet for demetallized oil; a cracking section connective with the demetallizing section and having an inlet for a source of hot, regenerated fluidized cracking catalyst and an outlet for cracked products and coked catalyst; separation means connected with the riser outlet for separating cracked products from deactivated cracking catalyst; means for removing additive from the riser; and a two stage regenerator comprising: a first stages lower regenerator stage with at least one inlet for a metal and coke containing additive and for coked catalyst, at least one inlet for oxygen containing gas, an upper outlet for discharging a two phase mixture of partially regenerated cracking catalyst and flue gas and an additive outlet for additive withdrawal; a second stage upper regenerator connective with lower regenerator having an inlet for of hot regenerated catalyst at least one inlet for oxygen containing gas and having an outlet for hot regenerated catalyst; means connecting the additive outlet from the lower regenerator stage to the demetallizing section at the base of the riser; and means connecting the regenerated catalyst outlet with the riser reactor.

BRIEF DESCRIPTION OF DRAWINGS

The FIGURE is a simplified, schematic presentation of an FCC reactor and two stage regenerator of the invention.

DETAILED DESCRIPTION

Figure 1:
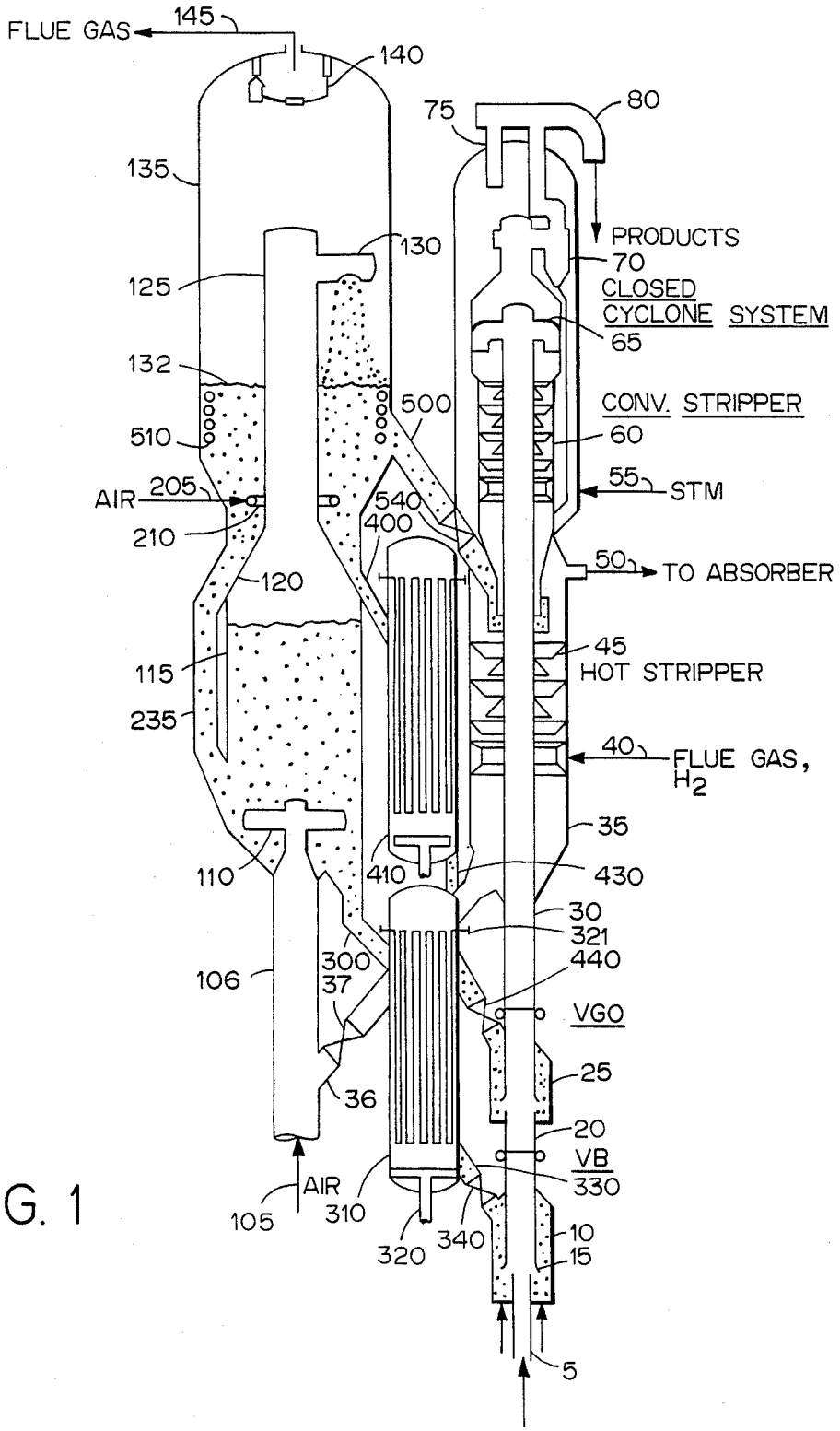

In the present invention a two stage regenerator is used to regenerate a coarse/fine catalyst mixture added to a single riser reactor to crack a heavy residual feed. Preferably, several feed points, at different elevations in the riser are used. The riser preferably discharges into closed cyclones, to quickly quench the riser cracking reactions, followed by conventional stripping of spent catalyst. An additional hot stripping stage is preferred and if used, will reduce somewhat the burning duty of the regenerator and greatly reduce hydrogen burning in the regenerator. Performance will be further optimized when internal and external catalyst coolers are used. Although many of the individual features of the invention are known, such as the conventional stripping of spent catalyst with steam before the spent catalyst enters the regenerator, the unique process and apparatus of the invention leads to unexpected results both in the reactor and the regenerator, with more efficient use of catalyst as well.

The invention will first be described in conjunction with the FIGURE. Following the discussion of the Figure, each of the systems used will be discussed in greater detail.

A heavy residual feed, such as a vacuum tower bottoms, is added to the base of the riser reactor 30 via line 5. The resid feed contacts hot regenerated catalyst, which may have a relatively low activity, and must have a higher settling velocity than conventional FCC catalyst. The hot, coarse, low activity catalyst is added via line 30 and valve 340 to mixing chamber 10. The resid/coarse catalyst mixture enters inlet 15 of the lower portion 20 of riser 30. Fuel gas is preferably used to fluidized the low activity catalyst. 1–10 weight percent steam is preferably added to the resid to assist in vaporization thereof.

The residence time of hydrocarbon feed in the lower zone will be relatively short, usually 0.1–2 seconds, and preferably 0.2–1 seconds. Most of the coke precursors and CCR material present in the feed will deposit on the coarse catalyst in this section of the riser, along with a majority of the metals, usually more than 90 percent of the metals in the feed. The coarse catalyst, which may have relatively low activity to start with, will be rapidly deactivated in this section of the riser. A majority, and preferably 90 percent, or most preferably all, of the residual feed is vaporized in this portion of the riser. Only limited catalytic cracking of residual feed occurs in the base of the riser, but extensive thermal cracking occurs. The heavy residual feed is also believed to be made more susceptible to further cracking by the severe thermal pretreatment experienced in the base of the riser.

Coarse catalyst and vaporized resid pass up the riser to contact hot, regenerated, relatively high activity catalyst in mixing zone 25. Hot regenerated catalyst is added via line 430 and control valve 440. The vaporized resid and hot, high activity catalyst are fairly easy to mix because resid vaporization is essentially completed upstream of this stage. In many refineries it will be desirable to add additional, lighter hydrocarbon charge stock such as vacuum gas oil to this location. The vaporized resid from the lower section 10, vacuum gas oil and other hydrocarbons, if any, and a mixture of hot, high activity regenerated catalyst and low activity, deactivated coarse catalyst pass up riser 30 and are preferably discharged from the riser via a closed cyclone system comprising riser outlets 65 and closed cyclone 70. The upper riser section 30 functions much like conventional riser cracking FCC units. Hydrocarbon residence times will typically be 0.5–10 seconds in this portion of the riser, with excellent results achieved with 1–5 seconds of residence time.

The closed cyclone system is the preferred way of rapidly separating cracked products from catalyst.

Catalyst recovered from reactor riser effluent is subjected to conventional steam stripping in stripper 60 with steam via line 55.

The conventionally stripped catalyst is then admixed with additional hot catalyst admitted via line 500 and control valve 540 in hot stripper 35 located beneath the conventional stripper and disposed in the annular space about riser 30. The mixture of coarse and fine catalyst is removed from hot stripper 35 via line 36 and control valve 37 and discharged into the inlet to the two stage catalyst regeneration system.

Preferably steam is used in the conventional stripper, and stripped hydrocarbons are simply recovered with the cracked products removed via line 75–80.

In the hot stripper 35, steam may be used but it is preferred to use a more vigorous stripping medium such as flue gas, perhaps with some additional hydrogen, to efficiently hot strip the already stripped catalyst. Catalyst passes down over baffles 45 to contact stripping gas admitted via line 40. Stripping gas and stripped hydrocarbons are removed via line 50, and preferably charged to an absorber not shown for product recovery. Although not shown in the drawing, the stripping gas and stripped products recovered via line 50 may also be mixed with the hydrocarbon products in line 80. Such mixing simplifies product recovery, but increases the load on the wet gas compressor, and downstream processing equipment associated with the catalytic cracking unit.

Preferably the catalyst residence time in the conventional stripper is 10–120 seconds, typically around 60 seconds. The residence time in the hot stripper should be even longer e.g., 60–600 seconds, and typically is around 200 seconds.

Hot stripped catalyst is removed via line 36 and valve 37 and discharged into the two stage catalyst regeneration system. Catalyst is mixed with air in line 105 and passes up through riser regenerator 106 to outlet 110 in the base of the first stage regeneration zone, shown as 115 in the drawing. Additional air or oxygen containing gas may be added to the first stage regeneration zone by means not shown in the drawing. The conventional catalyst, because of its relatively low settling velocity, will segregate from the coarse catalyst and rise to the top of the first stage regenerator. Much of the catalyst will be swept upwards, and as the gas velocity increases through narrowing section 120, the conventional catalyst is rapidly removed from the regenerator, and passed through the dilute phase transport riser 125 and discharged via outlet 130. The coarse catalyst, because of its higher settling velocity remains in the first stage of the regeneration zone and is withdrawn via line 300 for reuse.

The conventional FCC catalyst accumulates as bed 132 inside the second stage regeneration zone 135. Additional air, or other oxygen containing gas is added via line 205 and distributor 210 to complete combustion of carbonaceous material remaining on the catalyst.

Flue gas will usually pass through one or more stages of cyclone separation, or other filtration means, before entering plenum 140, to be discharged via line 145.

Several heat exchangers are provided. Usually the heat exchangers will remove heat from the system, during normal operation, although during startup or when charging unusual charge stocks it may be beneficial to add heat to various heat exchangers.

Heat exchanger 310 takes hot, regenerated low activity catalyst from the first stage regenerator, zone 115, and cools it prior to contact with resid. Hot catalyst enters the heat exchanger 310 via line 300 and leaves via outlet line 330. A heat exchange fluid, usually boiler feed water, enters the base of the heat exchanger via line 320 and leaves as steam via outlet 321.

Heat exchanger 410 cools hot, regenerated conventional FCC catalyst of relatively high activity intermediate the second stage regeneration zone 135 and the riser. Hot catalyst is removed from the second stage regenerator via line 400 and passes through heat exchanger 410 and leaves via lines 430 and valve 440 for the riser. Boiler feed water enters the base of the regenerator via inlet 420 and leaves as steam via outlet 421.

Heat exchangers 310 and 410 are both external heat exchangers. Appropriate bypass means may be used, not shown in the drawing, to permit their removal from service for repairs, maintenance or the like.

An internal heat exchanger 510 may be added to the second stage regenerator zone 135. A coolant fluid, usually boiler feed water, is added to tubes 510 and withdrawn by means not shown as a heated fluid.

Although not shown in the drawing it is also possible to have additional heat exchange means, e.g, an internal heat exchanger may be used in the base of the first stage regeneration zone 115, or an external heat exchanger may be used to cool hot catalyst from the hot stripper before it enters the regeneration zone. An internal heat exchanger may also be placed in the upper, dilute-phase region of the second stage regeneration vessel 135.

A more detailed description of each of the subsystems used in the present invention follows.

CATALYST MIXTURE

It is essential to use a catalyst mixture of "fine" and "coarse" catalyst which can be readily separated by elutriation in the two stage regenerator. The "fine" catalyst will have a relatively high activity and usually have a smaller particle size than the coarse catalyst. The "coarse" catalyst will usually have low catalytic activity, and a high vanadium affinity.

The fine catalyst is preferably a conventional FCC catalyst, e.g., a composite of 5–50 weight percent high activity zeolite in an amorphous matrix. The conventional FCC catalyst may be any commercially available, or hereafter developed, FCC catalyst. Catalysts designed to process residual stocks can be used very well as "fine" catalysts in the practice of the present invention, although use of the specialized catalyst is not necessary. All amorphous catalyst can also be used, but zeolite based catalysts are preferred. Especially preferred are catalysts containing both large pore zeolites (such as zeolite X and zeolite Y) and intermediate-pore zeolites (such as ZSM-5, ZSM-11 and similar materials). Super stable forms of zeolite Y, such as Ultrastable Y (USY) are preferred. When mixtures of intermediate pore and large pore zeolites are used, it is not necessary that they be in the same particle, although both catalysts should have about the same particle size distribution.

Specialized catalysts for resid conversion can be used. Typical of the specialized catalyst is RCCC-1, the preparation of which is disclosed in European patent application EP 0 074 501 A2. Another catalyst which is useful for converting resids is disclosed in U.S. Pat. No. 4,407,714, which is incorporated herein by reference.

Typical FCC catalysts have an average particle size of around 60 microns diameter, although individual units and catalyst manufacturers can cause quite a variation. Conventional FCC catalysts will have little or no catalyst with a particle size less than 20 microns. Usually 5–25 weight percent of the catalyst particles will be 40 microns or less. Typically 60–100 percent of the particles are 80 microns in size or less.

The coarse particles may be made of the same material as the conventional FCC catalyst, simply having a larger particle size. They may also be about the same size, but much denser. A combination of size and density may also be used to achieve more rapid settling of "coarse" catalyst in the FCC regenerator. Use of a relatively large, low density, soft material as a coarse catalyst may be preferred when charging feeds with exceptionally high metals contents. The large, light materials can be made to settle rapidly, but being less dense they will usually be subject to rapid attrition and wear. They will become rapidly saturated with metals, break down into finer particles called "fines", and very shortly thereafter be discharge from the unit with the flue gas for recovery in a downstream electrostatic precipitator, cyclone separator, or the like.

Usually the size of the conventional FCC catalyst will be fixed to correspond to that conventionally available. This will make for cheap sources of supply, and permit use of existing stocks of equilibrium catalyst for starting up the unit. The size, shape, and density of the coarse catalyst should be selected so that a majority of the coarse catalyst is retained in the first stage regeneration zone while a majority of the conventional catalyst passes from the first stage regeneration zone to the second stage regeneration zone. Efficiency of separating coarse from fine catalyst can be enhanced by proper design of the first stage zone and the transition zone leading from the first stage to the dilute phase transport riser. Addition of cyclone separators to the first stage zone can also be used to improve the efficiency of separation. As a general guideline, the terminal velocity of the coarse catalyst should be at least 50 percent greater, and preferably 100 percent greater, than the terminal velocity of the conventional catalyst particles. The terminal velocity of a typical FCC round catalyst particle of 75 micron diameter is 0.2 feet per second, so the terminal velocity of the coarse catalyst, the demetallizing additive, should be at least 0.3 feet per second and more preferably is 0.4 to 5 feet per second and the cracking catalyst has an average settling velocity of less than 0.3 feet per second.

The coarse particles must have a faster settling rate than the conventional FCC catalyst, but the coarse particles must also be readily fluidizable. Fairly coarse particles, e.g., 100–250 micron range particles can be readily fluidized in the process of the present invention because of the presence of large amounts of conventional FCC catalyst which promotes fluidization of the coarser particles.

The coarse catalyst, the demetallizing additive, properties should be selected to maximize removal of metals and carbonaceous materials. The catalyst incurs little penalty for having low catalytic activity. If the catalyst had high activity, it would rapidly lose it due to coke and metals deposition.

The coarse catalyst may include antimony or other materials to act as metal passivators. The catalyst may include a vanadium scavanger such as that described by Wormsbecher et al in the paper presented at the Ninth North American Catalyst Society Meeting, Houston, TX, Mar. 18–21, 1985.

The coarse catalyst can also be a material which is relatively cheap, such as naturally occurring clays, catalyst fines from other refinery processes, etc.

MgO (magnesium oxide) or CaO (calcium oxide), with a minor amount of other matrix materials such as silica or alumina, should give a particle with ideal properties. The MgO and CaO are inherently soft and light and would attrit rapidly and would be elutriated from the unit as metals deposited on it.

Although the use of cheap, efficient metal scavengers is preferred and permitted by the present invention, it is not essential to use such scavengers. Larger particles of catalyst having the same composition as conventional FCC catalyst can also be used with good results. Spent hydrotreating or hydrocracking catalyst can be used, so long as it has the proper fluidizing properties.

The specialized, high activity, resid-conversion catalyst discussed above (such as RCCC-1) may be used as the coarse catalyst. Such catalysts have very desirable pore size distributions, however they are fairly expensive because, inter alia, they contain 30–40% zeolite. Most or all of the zeolite content can be eliminated from the coarse catalyst contemplated for use herein.

TWO STAGE REGENERATOR

Although a stacked, two stage regenerator, with a riser mixing/combusting inlet is shown on the drawing, this is not essential for the practice of the present invention.

Any two stage regenerator can be used which will allow efficient separation of coarse from fine catalyst. It is possible to eliminate the riser mixing combustion zone 106 shown in the drawing and have catalyst discharge directly into the first stage regeneration zone 115.

The regenerator design shown in the Figure is the preferred design. The operating conditions in each part of the regenerator will be discussed briefly hereafter.

In the riser mixer 106, the conditions preferably will be 1100–1200° F., a superficial velocity of 20–40 ft/sec, and a catalyst density of 1.5–10 lb/ft$^3$.

In the first stage zone 115 the conditions preferably will be 1150–1300° F., a superifical velocity of 2 to 8 ft/sec and a catalyst density from 3–25 lb/ft$^3$.

In the dilute phase transport riser 125 the conditions will be 20–40 ft/sec superficial gas velocity, 1200–1350° F., densities (including solids) of 1.5 to 7 lb/ft$^3$. $CO_2/CO$ ratios will generally range between 0.4 to infinity. The metallurgy and design of this section will generally be that required to support the riser, preferably as described in patent application Ser. No. 139,519, Humble et al, incorporated herein by reference. The conditions in this portion of the system will of course be influenced heavily by any heat removal practiced in zone 115.

In the second stage regenerator, zone 135, the operating temperature will be generally 1225–1500° F. depending on whether heat is removed in this section. Vapor velocity will generally be between 2 and 4 ft./sec. Catalyst density in the vapor phase will generally be in the range of 0.05 to 0.7 lb/ft$^3$. In the dense phase the densities will generally fall in the 20–40 lb/ft$^3$ range.

Preferably, air is added to the lower portion of the first stage regenerator at several elevations, through spargers. This minimizes turbulence and minimizes entrainment of conventional FCC catalyst with additive recycled to the demetallation zone. It provides a more "staged" regeneration of additive, which is also beneficial. It helps to promote a generally reducing atmosphere in the first stage. The CO content of the flue gas from the first stage regenerator is preferably at least 1 mole % and more preferably 2 to 10 mole %.

RISER REACTOR

The process of the present invention uses a single riser reactor with multiple points of catalyst injection. Although it is essential to have the coarse catalyst added to the bottom of the riser reactor, with the conventional FCC catalyst added to a downstream portion of the riser reactor, it is also possible and extremely beneficial to split the feed to the riser reactor.

In one extreme, all of the feed (either pure resid, or resid mixed with various diluents, hydrogen donors, or recycled streams) may be added to the base of the riser.

It is very beneficial to also add lighter, more conventional feed streams to one or more locations of the riser reactor at higher elevations.

The superficial vapor velocity in the base of the riser zone 20 in the drawing, will be 10–30 feet per second. It may be beneficial to size the base of the riser so that the slip velocity of the coarse catalyst is 50–90 percent of the superficial vapor velocity in the riser. This will lead to significantly increased residence time of the coarse catalyst material in the base of the riser. Preferably there is a significant increase in superficial vapor velocity in the upper portions of the riser, region 30, so that both coarse and fine catalyst move rapidly up the riser.

Good feed distribution in the base of the riser is essential for this, or any other FCC operation. The preferred catalyst/oil mixing device for use in the base of the riser is described in U.S. Pat. No. 4,717,467, which is incorporated herein by reference. Any other suitable mixing device may be used as well, such as that of U.S. Pat. No. 4,555,328, which is incorporated by reference.

CLOSED CYCLONE SYSTEM

To minimize non-selective thermal-cracking, it is preferred that the riser discharge into a closed cyclone system which will rapidly separate catalyst from cracked products. Such a system is described in our U.S. Pat. No. 4,737,346, Haddad, Owen, Schatz which is incorporated herein by reference.

CONVENTIONAL STRIPPER

Any conventional stripper may be used which contacts coke deactivated catalyst with a stripping stream usually steam prior to regeneration of the catalyst. This part of the process is conventional.

HOT STRIPPER

Although not essential, it is very beneficial if the conventionally steam stripped catalyst is subjected to a further stripping operation in a hot stripper. Preferably, the catalyst is heated by adding some hot, regenerated catalyst to the stripped catalyst. Reactive gases, such as ethylene, may be added to generate heat. More details of our preferred hot stripped may be taken from our copending application U.S. Ser. No. 063,713, filed June 15, 1987, which is incorporated herein by reference.

Another preferred stripping medium is high temperature $CO_2$, which may be available from combustion of CO rich flue gas or some other source.

The use of $CO_2$ as the stripping medium results in at least partial removal of hydrogen associated with the carbonaceouse deposits. The reaction of $CO_2$ with hydrogen to produce CO and water is known as the Hettinger reaction. It is a very slightly exothermic reaction accomplished at temperatures of 1000–1200° F. Hot $CO_2$ stripping will remove a significant amount of hydrogen from the catalyst before the oxygen regeneration of the catalyst. Typically 25–50% of the hydrogen may be removed by reaction with $CO_2$ in a hot stripper. This reduces the heat released by combustion of hydrogen in the regenerator, and also significantly reduces the steam partial pressure in the regenerator, which will extend catalyst life.

When the hot stripper is operated at slightly higher temperature, e.g., 1300–1500° F., it is possible to remove not only hydrogen but carbon from the catalyst by reaction with either $CO_2$ or steam. Usually the temperature in the hot stripper will not be high enough to result in significant carbon removal by these mechanisms, but a limited amount of coke removal can occur due to steam/$CO_2$ stripping, and this is beneficial.

After stripping, the catalyst is charged to the two stage regenerator, previously discussed.

CATALYST COOLERS

When processing heavy feeds, with high levels of Conradson carbon, the feed will usually deposit more carbon on the catalyst than is needed to heat balance the unit. Catalyst coolers allow heat to be efficiently removed and control temperature rise in the regenerator vessels when they are incorporated in the fluid bed as shown as 510.

Catalyst coolers may be used to cool coarse catalyst intermediate the first stage of catalyst regeneration and the base of the riser.

One or more catalyst coolers may be used to cool the conventional, regenerated catalyst intermediate the second stage of catalyst regeneration and the riser reactor.

Coils or other heat exchanger means may be immersed in the dense bed or placed in the dilute phase of the second stage of catalyst regeneration to remove heat.

$NO_x$ CONTROL

The two stage regenerator design of the present invention is also efficient at minimizing $NO_x$ emissions. This is because most of the $NO_x$ emissions comes from combustion of nitrogenous coke in an oxidizing atmosphere. In the present invention, much of the coke combustion occurs in the first stage regenerator 115, operating with a relatively reducing atmosphere. $NO_x$ formed by the combustion of nitrogen containing coke is rapidly reduced to nitrogen in the first stage zone.

Combustion of nitrogen containing coke in the second stage zone will result in much more $NO_x$ production per unit weight of coke burned (as compared to combustion in the first stage zone) but much of the nitrogen in the coke has been burned from the conventional catalyst before it reaches the second stage regenerator. Preferably at least 50% of the coke, and ideally 60–90% or more, of the hydrogen in the coke are burned upstream of the second stage of regeneration.

CO EMISSIONS

Coke combustion in the first stage zone will usually lead to a roughly equal molar mixture of CO/$CO_2$. By manipulating heat removal devices and air rate in the first stage zone, this could vary widely however. The flue gas discharged via outlet 130 will usually contain significant amounts of carbon monoxide. This reduces the amount of heat released in the regenerator, but means that a CO boiler or other means of dealing with carbon monoxide must be used. If desired, CO combustion can be allowed to occur in the dilute phase zone within the upper portion zone 135, with for instance the addition of a catalyst fountain to the second stage of the regenerator. A catalyst fountain or high superficial velocities may be used to get more catalyst into the dilute phase to absorb the heat of CO combustion. Usually it will be preferable, when processing resids, to maximize CO production in the regenerator and shift the combustion of carbon monoxide to a downstream CO boiler.

PROCESS INTERACTIONS

The unique and beneficial interaction of the systems of the present invention can best be understood by discussing the process steps experienced by the resid feed, and by the catalyst mixture.

The resid feed is demetalized, decoked, and rendered susceptible to catalytic cracking in the base of the riser 20. The metals, and most of the coke precursors, deposit on the coarse catalyst. The cleaned, vaporized resid contacts fresh conventional FCC catalyst and is cracked in a short term riser cracking zone 30. The resid behavior approaches that of conventional heavy gas oil feeds to FCCs. The fine catalyst behavior is much like conventional FCC catalyst. The only change in operation in riser 30 is the presence of relatively coarse catalyst, coked and laden with metals, which happens to be present in the riser but exerts little effect therein.

Catalyst and cracked products are rapidly separated using the closed cyclone system. The mixture of coarse and conventional catalyst passes through the conventional stripper to the hot stripper. The hot stripper significantly decreases the amount of hydrogen remaining in the coke on catalyst. This reduction in hydrogen increases yields of valuable hydrocarbon product and reduces the amount of material that must be burned in the regenerator. It also greatly reduces the amount of $H_2O$ formed in the regenerator, and it is the $H_2O$ which damages the zeolite catalyst and which may play a role in formation of vanadium species which attack the conventional catalyst.

The thoroughly stripped catalyst is subjected to intense mixing with inlet air and to some regeneration, in riser 106. The conditions in first stage zone 115 are relatively mild, i.e., there is a reducing atmosphere generally present therein, and temperatures are much lower than they are in the second stage of regeneration. Carbon burning is not especially rapid at these conditions, but there is no special benefit to obtaining extremely low carbon levels on regenerated catalyst. The regenerator can be sized to provide enough residence time to adequately clean the coarse catalyst, while allowing the conventional catalyst to rapidly elute out of the first stage zone.

Although the first stage zone is only moderately efficient at carbon burning, it is extremely efficient at removing hydrogen remaining in the hydrocarbonaceous coke. This means that all of the water precursors are removed from the catalyst, both conventional and coarse, in the first stage zone where conditions are relatively mild.

When conventional catalyst reaches the second stage zone, it is fairly clean, typically containing 0.1–0.2 weight percent coke. The coke comprises more than 90 weight percent carbon and much less than 10 weight percent hydrogen, usually less than 5 weight percent hydrogen.

In the second stage zone, the catalyst is extremely hot, and very dry. It is hot because residual feeds contemplated for use herein deposits a lot of coke on the catalyst and result in high regenerator temperatures. It is very dry in the second stage because all the water of combustion from the first stage, and entrained stripping steam has been removed from the catalyst. Essentially the only water present in the dense bed of catalyst in the second stage regenerator is water of combustion formed in this bed. Because of the low hydrogen content of the coke in this dense bed, and because there is very little coke on catalyst entering this bed (typically 0.1–0.3 wt %) $H_2O$ partial pressures can be an order a magnitude less than $H_2O$ partial pressures in conventional single stage FCC regenerators. $H_2O$ partial pressures of 1–2 psia above the entering air, and preferably less than 1 psia above the entering air in the dense bed of catalyst in the second stage regenerator are expected.

The coarse catalyst acts as a metal sink and CCR sink. The coarse catalyst keeps the metals in the resid feed from contaminating the conventional cracking catalyst. Because the coarse catalyst is regenerated under relatively reducing conditions, nitrogen oxides emissions are drastically reduced. Oxidation of metals, particularly vanadium, deposited on catalyst is minimized.

The conventional catalytic cracking catalyst is able to function as if the feed were a relatively conventional material. Such metals as slip by the coarse additive and are deposited on the conventional FCC catalyst are maintained in generally lower oxidation state, because much of the catalyst regeneration occurs in the first stage, a generally reducing atmosphere regeneration. The high temperature, oxidizing conditions in the second stage are fairly severe, but there is almost no water present in the second stage of regeneration so zeolite stability is improved and formation of vanadic acid and other materials is minimized.

If practicing this now, we would react vacuum bottoms in the bottom of a riser reactor, using a light hydrocarbon, preferably partially olefinic, as a lift gas, and put in a more hydrogen-containing stock, such as virgin gas oil, as secondary feed. We would use a super stable Y mixed with rare earth stabilized Y zeolite on a mildly active matrix, such as GXO 25, as the high activity catalyst. The coarse material would be: (1) an alumina "sponge" to pick up vanadium etc.; (2) ART type catalyst (a low activity clay material); (3) coke from a fluid coker or ground coke from a delayed coker elutriated to proper particle size, depending on cost and effectiveness of these for demetallizing the heavy feedstock.

The coke, if used, can also supply external heat to generate steam or increase the temperature rise in one of the regenerator vessels or to increase the temperature in a regenerator vessel and make the catalyst or coarse additive material hotter and thereby increase the temperature in one portion of the riser.

We claim:

1. A process for the catalytic cracking of a heavy, metals laden hydrocarbonaceous feed by contacting a hot regenerated catalyst stream with the feed in a base of riser reactor, cracking the feed in the riser reactor at catalytic cracking conditions to form cracked products and coked catalyst containing metals, separating the coked catalyst from cracked products, stripping the coked catalyst with steam and regenerating the steam stripped catalyst regenerator with an oxygen-containing gas to form hot regenerated catalyst, characterized by:

(a) using a mixture of fluidizable catalytic cracking catalyst and a demetallizing additive, which mixture is resolvable by elutriation;

(b) demetallizing the feed by contacting the feed in the base of the riser reactor with the demetallizing additive and removing a majority of the metals and some coke from the feed to produce a coked additive containing a majority of the metals content of the feed and a demetallized feed;

(c) cracking the demetallized feed in the riser reactor with the hot regenerated cracking catalyst and discharging from the riser reactor cracked products and a mixture of coked cracking catalyst and coked additive;

(d) regenerating the mixture in a first stage regenerator having a base, at least one inlet for coked catalyst and additive, an upper outlet and a lower outlet by adding the mixture to the first stage regenerator, contacting the mixture with an oxygen-containing gas at coke combustion conditions, segregating by elutriation a dense phase fluidized bed with an increased concentration of demetallizing additive, relative to the mixture discharged from the riser, to form a dense phase fluidized bed of regenerated demetallizing additive with a reduced coke content and partially regenerated catalytic cracking catalyst;

(e) removing from the lower outlet of the first stage regenerator a regenerated demetallizing additive and recycling it to the base of the riser reactor;

(f) removing from the upper outlet of the first stage regenerator the partially regenerated catalytic cracking catalyst and discharging it into a second stage regenerator;

(g) regenerating the partially regenerated catalytic cracking catalyst with an oxygen containing gas in the second stage regenerator to produce regenerated catalytic cracking catalyst;

(h) recycling regenerated catalytic cracking catalyst from the second stage regenerator to the riser reactor.

2. The process of claim 1 further characterized in that the mixture of coked cracking catalyst and coked additive discharged from the riser is steam stripped at an elevated temperature and then subjected to an additional stripping step at a higher temperature.

3. The process of claim 2 further characterized in that the additional stripping step comprises contact with carbon dioxide at about 1050–1250° F.

4. The process of claim 1 further characterized in that an external additive cooler which is intermediate the lower outlet of the first stage regenerator and the base of the riser reactor cools regenerated demetallizing additive.

5. The process of claim 1 further characterized in that an external additive cooler which is intermediate the second stage regenerator and the riser reactor cools regenerated cracking catalyst.

6. The process of claim 1 further characterized in that a heat removal means removes heat from the second stage regenerator.

7. The process of claim 1 further characterized in that the mixture of coked additive, coked catalyst and cracked products is discharged from the riser reactor into a cyclone separator.

8. The process of claim 1 further characterized in that the coked catalyst and coked additive are stripped with steam and the steam stripped mixture is mixed with an oxygen containing gas in a riser mixer upstream of the first stage regenerator and discharged into the first stage regenerator.

9. The process of claim 1 further characterized in that the demetallizing additive is selected from the group of alumina, low activity clay, coke particles, and magnesium oxide.

10. The process of claim 1 further characterized in that the demetallizing additive has an average settling velocity in the catalytic cracking process of 0.4 to 5 feet per second and the cracking catalyst has an average settling velocity of less than 0.3 feet per second.

11. The process of claim 1 further characterized in that the flue gas from the first stage regenerator contains 2 to 10 mole % CO.

12. The process of claim 1 further characterized in that the oxygen containing gas is added to the first stage regenerator at multiple levels in the dense phase fluidized bed of additive through spargers which minimize turbulence and agitation of the dense phase fluidized bed of additive.

* * * * *